US006464596B1

(12) United States Patent
Belding

(10) Patent No.: US 6,464,596 B1
(45) Date of Patent: Oct. 15, 2002

(54) GOLF CLUB ALIGNMENT ATTACHMENT

(76) Inventor: Randy S. Belding, 1116 E. 7th St., Pella, IA (US) 50219

( * ) Notice: Subject to any disclaimer, the term of this patent is extended or adjusted under 35 U.S.C. 154(b) by 0 days.

(21) Appl. No.: 09/735,188

(22) Filed: Nov. 7, 2000

(51) Int. Cl.[7] ..... A63B 53/06; A63B 53/16; A63B 69/36; A63B 57/00

(52) U.S. Cl. ..... 473/257; 473/219; 473/251; 473/236

(58) Field of Search ..... 473/236–237, 473/238–239, 240, 244, 251, 252, 253, 219, 242, 223, 226, 265, 257

(56) References Cited

U.S. PATENT DOCUMENTS

| | | | | | |
|---|---|---|---|---|---|
| 2,621,044 | A | * | 12/1952 | Sloan | 473/236 |
| 3,021,141 | A | * | 2/1962 | Polsky et al. | 473/236 |
| 4,002,343 | A | * | 1/1977 | Eckert | 473/251 |
| 4,944,517 | A | * | 7/1990 | Redkey | 473/236 |
| 5,011,153 | A | | 4/1991 | Watkins | |
| 5,351,961 | A | | 10/1994 | Eulau | |
| 5,441,268 | A | | 8/1995 | Shier | |
| 5,476,262 | A | * | 12/1995 | Bandiero | 473/251 |
| 5,810,675 | A | * | 9/1998 | Weathers | 473/236 |
| 5,924,935 | A | * | 7/1999 | Prewitt | 473/236 |
| 5,961,392 | A | | 10/1999 | Hillock et al. | |

* cited by examiner

*Primary Examiner*—Paul T. Sewell
*Assistant Examiner*—Mitra Aryanpour
(74) *Attorney, Agent, or Firm*—McKee, Voorhees & Sease, P.L.C.

(57) ABSTRACT

A U-shaped alignment attachment is mounted on a putter and includes laterally inwardly spaced apart parallel leg extensions which have rearward ends spaced sufficiently from the golf ball when being addressed that they will engage the golf ball when the club is moved rearwardly on the backstroke if the club is off the intended line and engage the forward ends of the leg extensions on the forward stroke giving immediate feedback to the golfer as a result of the golf ball going off in an exaggerated mishit direction. Appropriate jaws are provided for mounting the attachment on different types of golf clubs.

15 Claims, 5 Drawing Sheets

GOLF CLUB ALIGNMENT ATTACHMENT

BACKGROUND OF THE INVENTION

The object of a golf shot is to hit a golf ball along a preselected imaginary line to a target including the hole in the green. Different aids are available for giving assistance in executing a desired golf shot but most do not provide clear feedback to the golfer that a mishit occurred. A golf putter alignment aid in U.S. Pat. No. 5,351,961 provides extension members on the golf putter which are intended to function as a guide to help line the putt to the hole. No direct feedback, however, is provided if the ball is mishit.

There is a further need for a fastening means for a golf club alignment attachment that will allow for quick attachment and removal from each of the different clubs used including the putter, irons and woods.

SUMMARY OF THE INVENTION

A pair of legs extend forwardly from the face of the golf club such as a putter and include parallel leg extensions inwardly offset from the legs and having forward and rearward ends. The rearward ends of the leg extensions are positioned far enough away from the putter face such that a golf ball positioned adjacent the putter face at the time the ball is being addressed prior to putting and moving the putter rearwardly on the back stroke will force the golfer to follow the correct path, otherwise the rearward ends of the leg extensions will engage the ball giving immediate feedback that the putter was being incorrectly stroked. As the putter moves forwardly it must move along the intended line to the target otherwise the forward edges of the leg extensions will engage the golf ball, again, knocking it off course and giving the golfer immediate feedback that the stroke was flawed.

The attachment is readily mounted on different types of clubs by a heel member interconnecting the rearward ends of the legs at their upper sides thus allowing the heel member to be positioned on the topside of the golf club with the face of the golf club engaging the rearward ends of the legs. A jaw is adjustably connected to the heel for engaging the backside of the club, such as a mallet head putter, for releaseably connecting the attachment to the club.

In one embodiment, a downwardly extending jaw plate engages the backside of the club with a bolt extending through the plate and into engagement with a threaded shoulder on the heel. In a second embodiment, a bolt threadably extends through a shoulder on the heel and the forward end of the bolt engages the backside of the golf club such as a flat head putter.

DESCRIPTION OF THE PREFERRED EMBODIMENT

Figure 4:
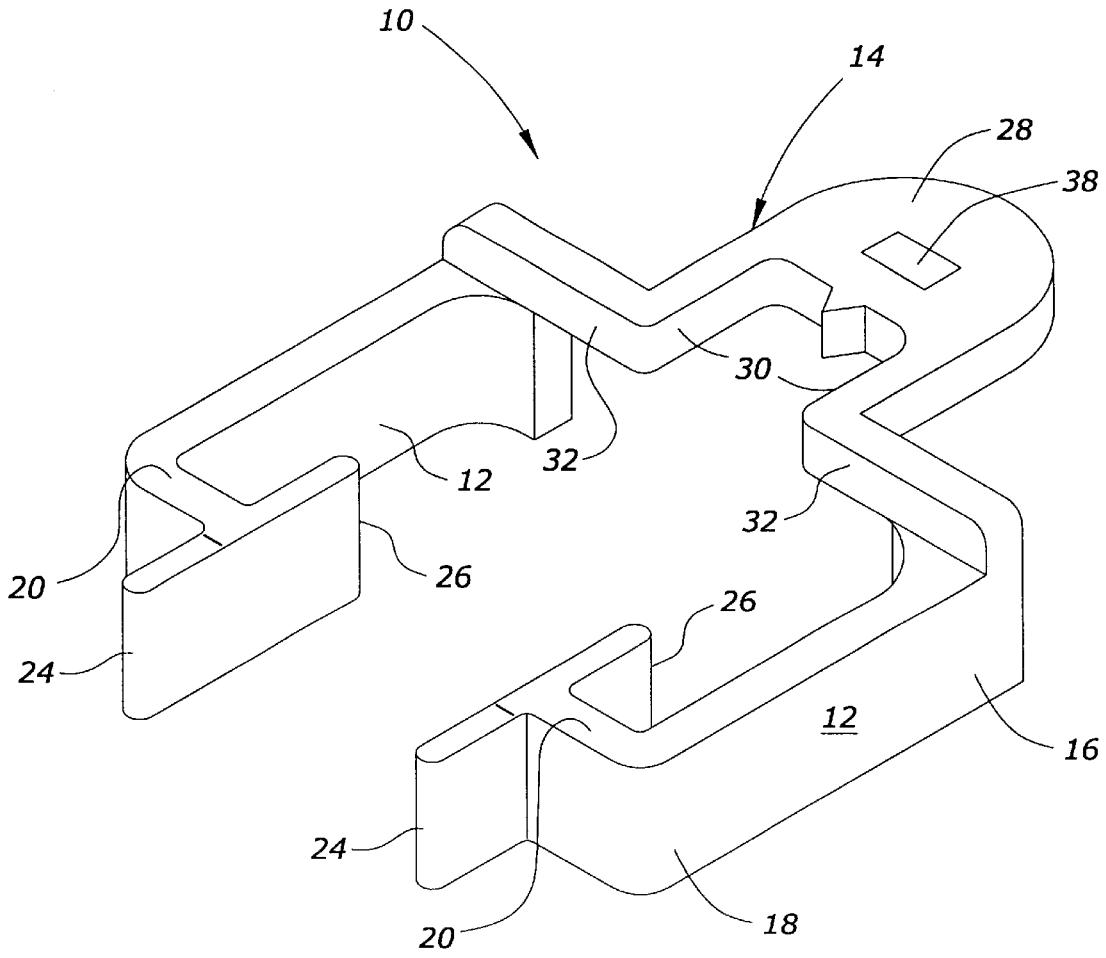
FIG. 4 is a perspective view of the attachment only.

The alignment attachment of this invention is referred to generally in FIG. 4 by the reference numeral 10 and includes spaced apart parallel legs 12 interconnected by a heel member 14 at their rear ends 16.

The legs 12 include forward ends 18 which terminate in laterally inwardly extending portions 20 which in turn terminate in parallel spaced apart leg extensions 22 in turn having forward ends 24 and rearward ends 26.

The heel member 14 is positioned on top of the legs 12 and includes a base portion 28 having forwardly extending arms 30 which terminate in laterally outwardly extending portions 32 which engage the top sides of the rear ends 16 of the legs 12. A V-shaped sighting means 34 is positioned on the center line of the forward face of the base portion 28.

Figure 1:
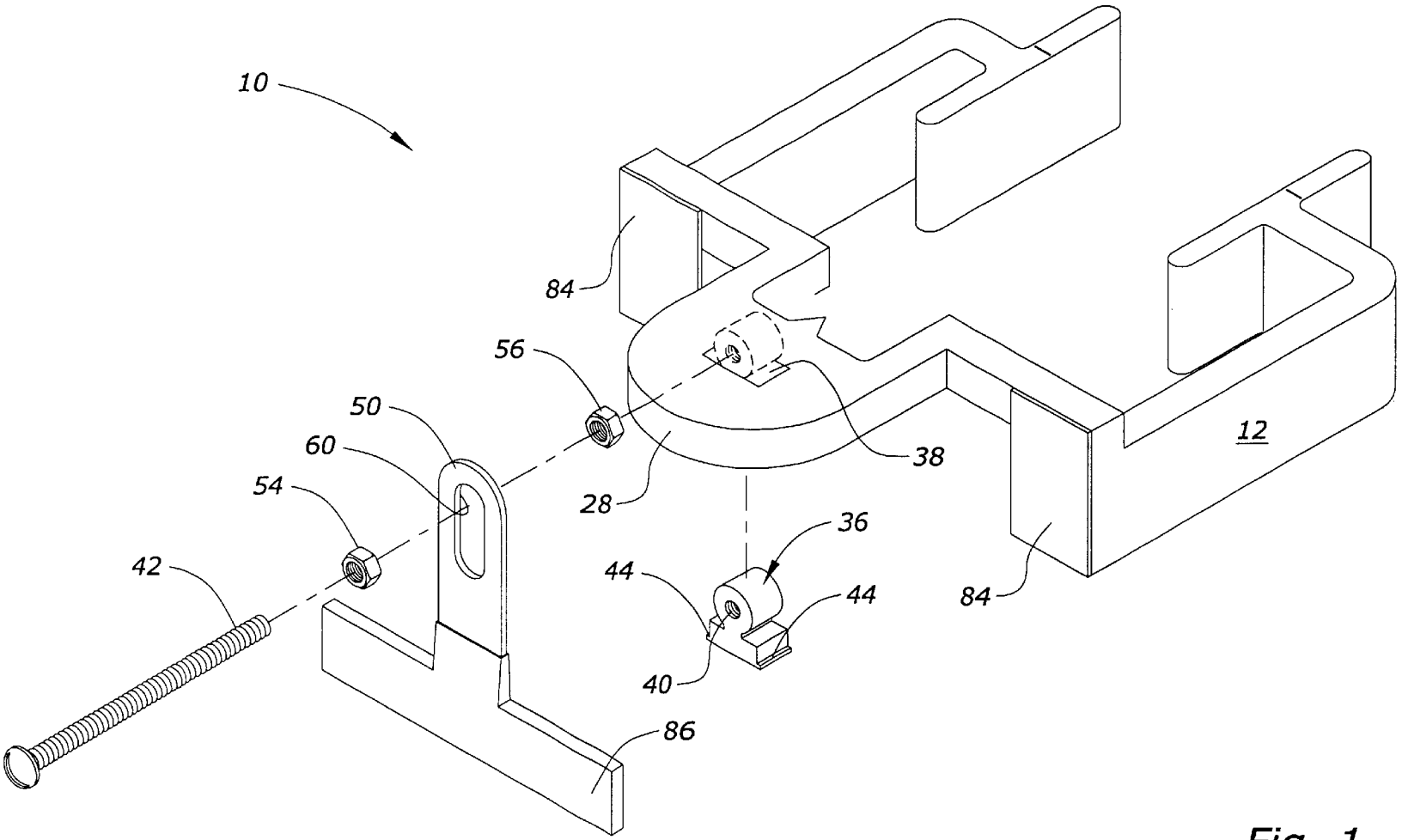
FIG. 1 is an exploded perspective view of the golf club alignment attachment showing a jaw plate for engagement with the backside of a Mallet head type putter.

As seen in FIG. 1, a shoulder means 36 is received in a vertical opening 38 in the heel 28. The shoulder 36 has a threaded opening 40 to receive a bolt 42. Outwardly extending ledges 44 limit passage of the shoulder means 36 entirely through the opening 38. The shoulder may be inserted either from the top or from the bottom.

Figure 2:
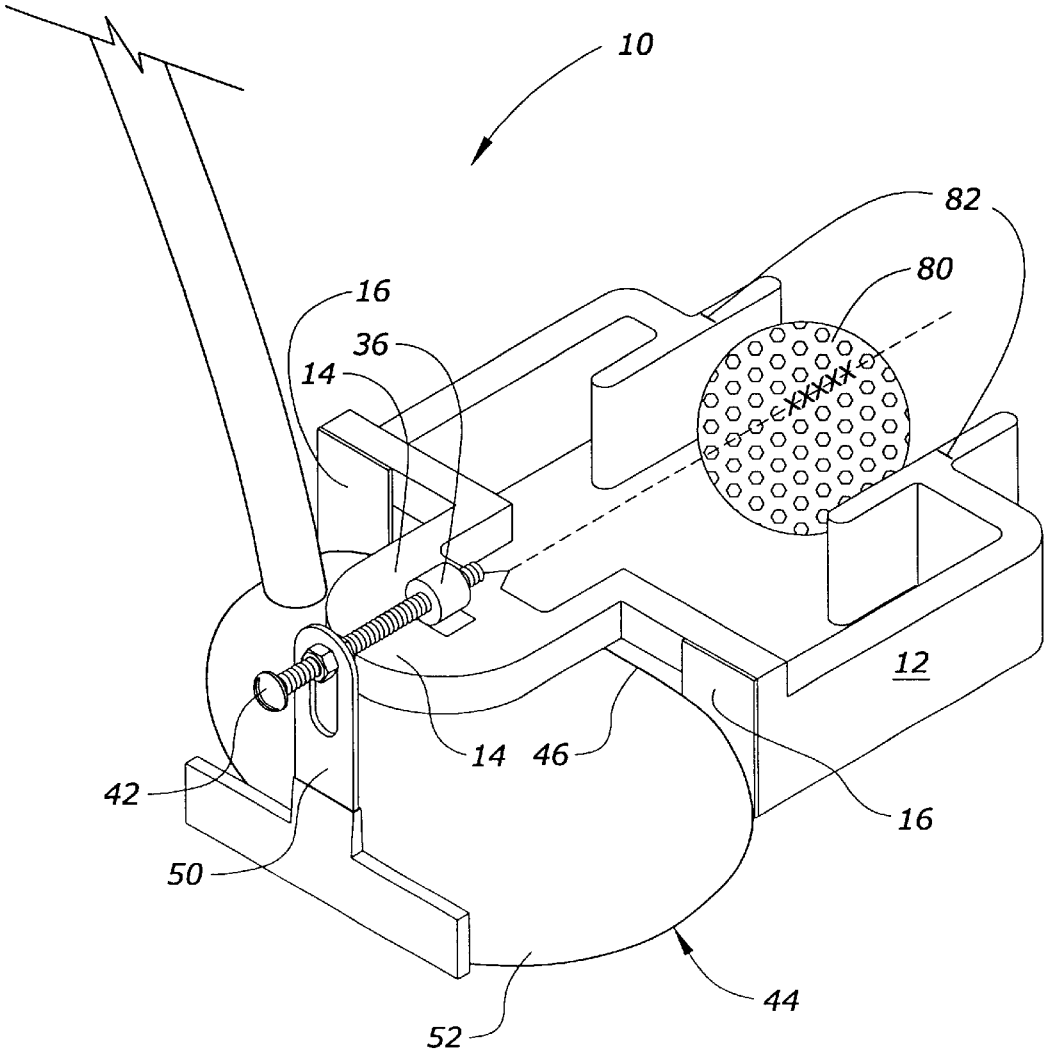
FIG. 2 is a perspective view of the alignment attachment mounted on a Mallet head putter.

The alignment attachment 10 is shown in FIG. 2 in association with a Mallet head putter 44 having its forward face 46 engaging the rear ends 16 of the legs 12 with the heel 14 positioned on top of the putter head.

A plate jaw 50 engages the backside 52 of the Mallet head putter 44 and is held tight thereagainst by the bolt 42 engaging nuts 54 and 56 on opposite sides of the jaw 50. The forward end of the bolt 42 engages the threaded opening 40 in the shoulder 36 positioned on the top side of the heel 14. An elongated slot 60 is provided in the jaw plate 50 to allow for vertical positioning of the jaw plate.

Figure 3:
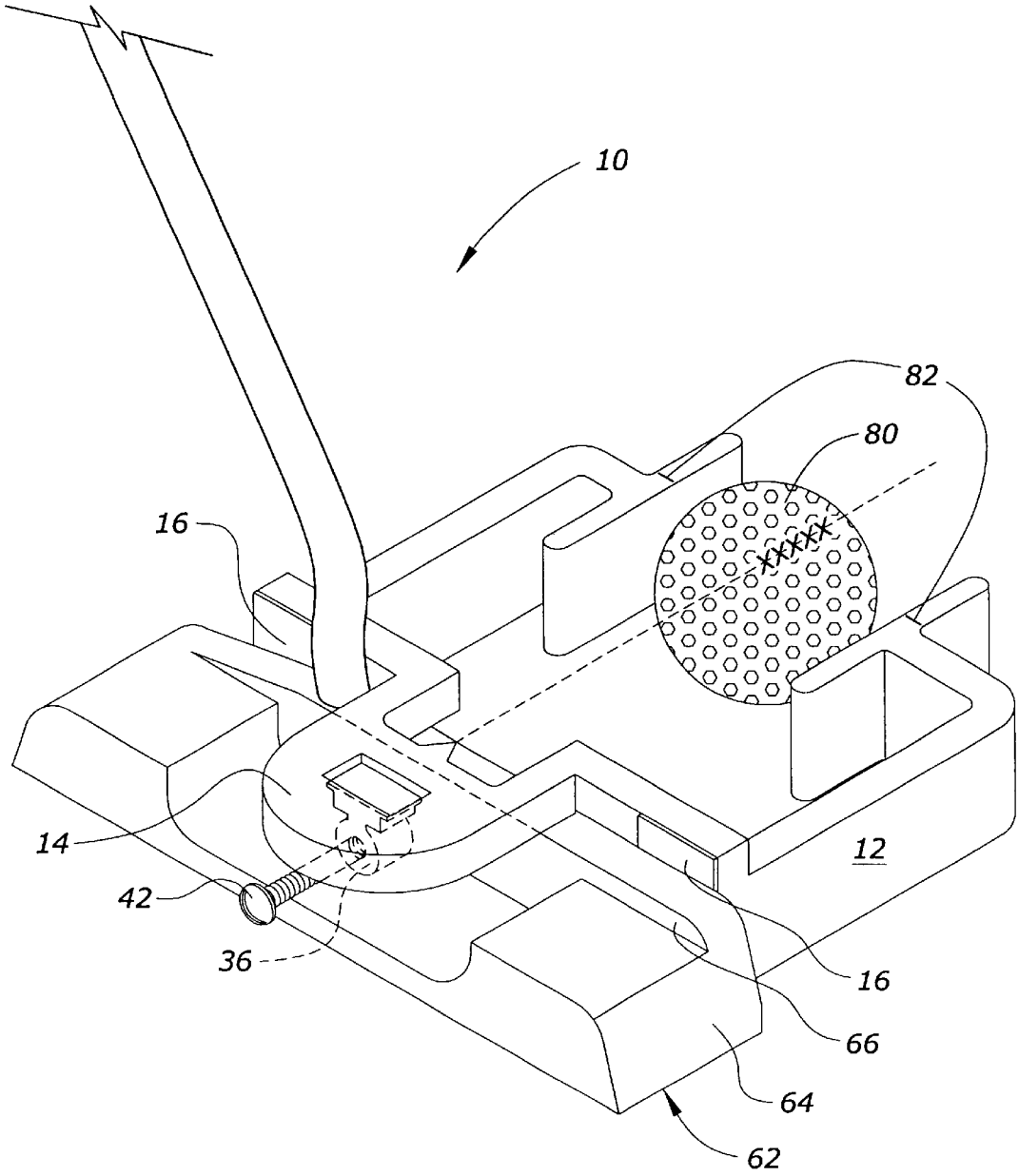
FIG. 3 is a perspective view of the alignment attachment mounted on a flat head putter.

In FIG. 3 the alignment attachment 10 is mounted on a flat head putter 62 having a blade 64 on the forward side in engagement with the rear ends 16 of the legs 12. The heel 14 extends over the putter head 62 and the shoulder 36 extends downwardly therefrom and receives the bolt 42 which engages the backside 66 of the blade 64 to removably lock the attachment to the putter.

Figure 5:
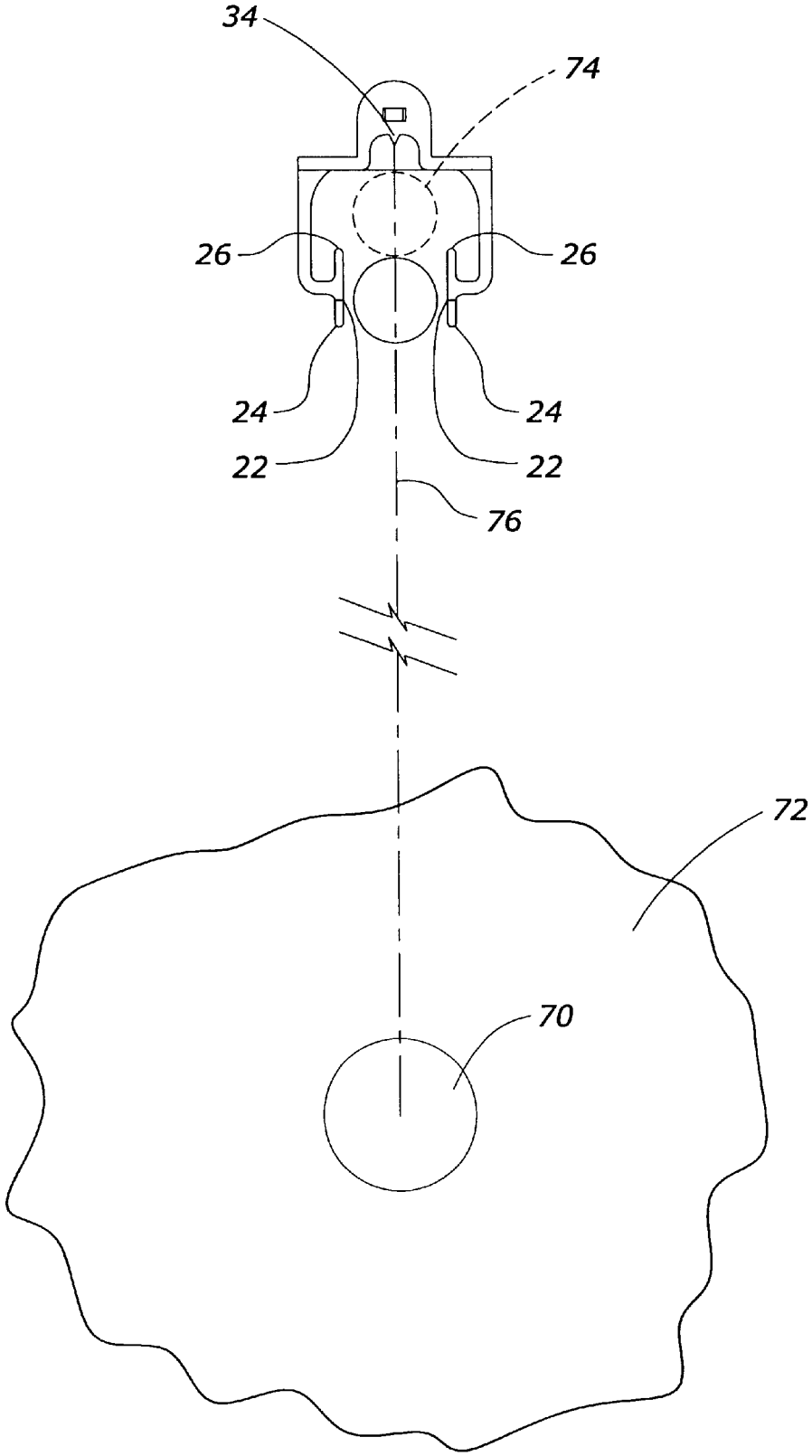
FIG. 5 is a top plan view of the alignment attachment in use for establishing a line to a hole in a golf green.

In use, it is seen in FIG. 5 that the target is a hole 70 on a green 72. The ball 74 is initially placed in the dash line position adjacent the putter blade (not shown). The spacing between the putter blade and the rearward ends 26 of the parallel leg extensions 22 may vary but should be substantially the diameter of the golf ball or more such that as the club head is moved rearwardly on the back stroke, the rearward edges 26 will engage the ball 74 if the projectory is not on the line 76 to the hole 70. As the putter moves forwardly, the forward ends 24 must clear the ball 74 otherwise engagement with the ball will cause it to go off in an exaggerated mishit direction which will send a clear message to the golfer that the stroke is off the intended line 76 to the hole 70.

The spacing between the leg extensions 22 may vary depending on the level of preciseness desired in the golf stroke.

The V-shaped sighting means 34 may also be used to help center the golf club on the line 76 to the hole 70 through the golf ball 74 and any markings 80 that may appear on it as seen in FIG. 2. Transversely extending guide lines 82 are provided on the top surfaces of the leg extensions 22 as seen in FIG. 2 and may be aligned with the ball marking 80 upon turning the ball 90 degrees to that shown in FIG. 2.

Protection to the finish of the golf clubs 44 and 62 is provided by a protective material 84 being provided on the rear ends 16 of the legs 12. The same is provided on the jaw plate 50 in the form of plastic 86.

It is thus seen that the alignment attachment 10 of this invention may be quickly attached to or removed from any type of club, and in particular, flat head putters 62 or Mallet head putters 44. In use, immediate feedback will be given to the golfer as to the accuracy of the stroke on the backswing as well as the forward swing as the ball 80 must clear the rear ends 26 of the leg extensions 22 on the backswing and the forward ends 24 on the forward stroke.

What is claimed is:

1. A golf club alignment attachment comprising, a pair of spaced apart parallel legs adapted
to be interconnected by a golf club and extend forwardly
from the golf club face, said legs having forward and rearward ends with said rearward ends adapted to extend
toward a golf club face, said pair of parallel legs having at
their forward ends laterally inwardly extending leg
portions, said leg portions having inner and outer ends, and laterally spaced apart parallel leg extensions on the inner ends of said leg
portions, and said leg extensions being parallel to said pair of parallel legs and having forward and rearward ends.

2. The golf club alignment attachment of claim 1 wherein said leg portions engage said leg extensions intermediate their forward and rearward ends.

3. The golf club alignment attachment of claim 1 wherein said rearward ends of said leg extensions terminate substantially short of the rearward ends of said parallel legs.

4. The golf club alignment attachment of claim 3 wherein said leg extension rearward ends are so positioned that a golf ball may be placed substantially rearwardly thereof.

5. The golf club alignment attachment of claim 4 and a heel member interconnects the rearward ends of said parallel legs.

6. The golf club alignment attachment of claim 5 wherein said parallel legs have top and bottom sides and said heel member is positioned above said bottom sides of said parallel legs and is adapted to be positioned on the top side of a golf club with the rearward ends of said parallel legs engaging the forward face of a golf club.

7. The golf club alignment attachment of claim 6 and said heel member is U-shaped and includes a base portion from which parallel arms extend forwardly and terminate in laterally outwardly extending portions which engage said rearward ends of said parallel legs.

8. The golf club alignment attachment of claim 7 wherein said base portion of said heel has forward and rearward ends and a sighting means is positioned on the forward end thereof centered between said pair of parallel arms.

9. The golf club alignment attachment of claim 8 wherein said sighting means is positioned rearwardly of the rear ends of said pair of parallel legs.

10. The golf club alignment attachment of claim 9 wherein said sighting means is V-shaped with the base of the V facing forwardly.

11. The golf club alignment attachment of claim 6 and a jaw having forward and rearward sides is adjustably connected to said heel and extends downwardly therefrom for engagement with the back side of a golf club.

12. The golf club alignment attachment of claim 11 wherein a bolt connects said heel to said jaw to provide said adjustability therebetween.

13. The golf club alignment attachment of claim 6 and a bolt having forward and rearward ends is adjustably connected to said heel with said forward end of said bolt adapted to engage the back side of a golf club.

14. The golf club alignment attachment of claim 6 and a shoulder means having a threaded opening is selectively positioned on a said heel to extend upwardly or downwardly and receive a bolt adapted to operatively engage a golf club.

15. The golf club alignment attachment of claim 14 wherein said shoulder means is received in a vertical opening in said heel allowing said shoulder means to be selectively positioned on the top or bottom sides of said heel.

* * * * *